US012760745B2

(12) United States Patent
Saka

(10) Patent No.: US 12,760,745 B2
(45) Date of Patent: Oct. 13, 2026

(54) BLOWER DEVICE

(71) Applicant: MINEBEA MITSUMI Inc., Nagano (JP)

(72) Inventor: Yoshikazu Saka, Kitasaku-gun (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 18/578,380

(22) PCT Filed: May 17, 2022

(86) PCT No.: PCT/JP2022/020474
§ 371 (c)(1),
(2) Date: Jan. 11, 2024

(87) PCT Pub. No.: WO2023/286438
PCT Pub. Date: Jan. 19, 2023

(65) Prior Publication Data

US 2024/0376904 A1 Nov. 14, 2024

(30) Foreign Application Priority Data

Jul. 13, 2021 (JP) ..... 2021-115738

(51) Int. Cl.
*F04D 29/42* (2006.01)
*F04D 29/62* (2006.01)

(52) U.S. Cl.
CPC ..... *F04D 29/4226* (2013.01); *F04D 29/626* (2013.01)

(58) Field of Classification Search
CPC .. F04D 29/281; F04D 29/4226; F04D 29/601; F04D 29/624; F28D 2021/0028;
(Continued)

(56) References Cited

U.S. PATENT DOCUMENTS 6,071,078 A * 6/2000 Schlegel ..... F28F 9/002 415/121.2
2005/0051309 A1* 3/2005 Mori ..... F28F 9/002 165/121

(Continued)

FOREIGN PATENT DOCUMENTS

JP 160501/1981 * 7/1981
JP S58-65781 U 5/1983

(Continued)

OTHER PUBLICATIONS

International Search Report for corresponding International Application No. PCT/JP2022/020474 mailed Aug. 2, 2022.

(Continued)

*Primary Examiner* — Ryan C Clark
(74) *Attorney, Agent, or Firm* — Chrisman Gallo Tochtrop LLC

(57) ABSTRACT

A blower case configured to accommodate an impeller and a bracket attached to an outer periphery of the blower case and configured to fix the blower device at a mounting target are included. At an outer peripheral surface of the blower case, a pair of rail parts extending in a direction of a rotation axis of the impeller and an engagement rib connecting the rail parts to each other at an intermediate portion in a longitudinal direction of the rail parts are provided. At the bracket, a pair of grooves fitted with the pair of rail parts and slidable in the direction of the rotation axis and a claw part disposed between the pair of grooves so as to be engaged with the engagement rib in the direction of the rotation axis are provided. A plurality of pairs of rail parts are provided along the outer periphery of the blower case, and the bracket can be selectively attached to the pair of rail parts.

10 Claims, 6 Drawing Sheets

(58) Field of Classification Search
CPC . F28D 2021/0029; H01L 23/40; H01L 23/46; F28F 9/001; F28F 9/002; B60H 1/00521; F05B 2240/90; F05B 2240/14; F05B 2260/30
See application file for complete search history.

(56) References Cited

U.S. PATENT DOCUMENTS

2006/0054306 A1* 3/2006 Kent ..... F28F 9/002 165/67
2009/0178781 A1* 7/2009 Park ..... F28F 9/002 165/149
2012/0328390 A1* 12/2012 Colpan ..... F25B 39/04 403/345
2013/0058712 A1* 3/2013 Kamiya ..... B60H 1/00521 403/376
2016/0001629 A1* 1/2016 Rohr ..... B60K 11/04 165/76
2017/0016647 A1* 1/2017 Kitagishi ..... B60H 1/00521
2017/0117773 A1* 4/2017 Beetz ..... B60H 1/00521
2017/0136846 A1* 5/2017 Philippin ..... F16M 13/02
2020/0362881 A1* 11/2020 Kimpara ..... F04D 29/4226
2020/0362882 A1* 11/2020 Fujita ..... F04D 29/601
2020/0386238 A1 12/2020 Fujita

FOREIGN PATENT DOCUMENTS

JP H03-104506 U 10/1991
WO WO-2019163820 A1 * 8/2019 ..... F04D 25/08

OTHER PUBLICATIONS

Written Opinion for corresponding International Application No. PCT/JP2022/020474 mailed Aug. 2, 2022.
English translation of Written Opinion for corresponding International Application No. PCT/JP2022/020474 dated Aug. 2, 2022.

* cited by examiner

BLOWER DEVICE

CROSS-REFERENCE TO RELATED APPLICATIONS

This application is a national stage entry of International Application No. PCT/JP2022/020474 filed on May 17, 2022, which claims the benefit of priority to Japanese Application No. JP2021-115738, filed Jul. 13, 2021, the entire disclosures of which are hereby incorporated herein by reference.

TECHNICAL FIELD

The disclosure relates to a blower device, and more particularly to an improvement in a structure for fixation at a mounting target.

BACKGROUND

Blower devices are widely used for air blowing, ventilation, cooling, and the like in household electrical appliances, office automation equipment, and industrial and vehicular equipment. In a related art, a centrifugal blower has a structure of blowing out air sucked in from an axial direction toward a centrifugal direction, and is provided with a casing including a spiral ventilation passage, and an impeller including a plurality of blades is accommodated in the casing. (For example, see WO2019/163820).

A blower device described in FIGS. 5 to 7 of WO2019/163820 is a centrifugal multi-blade blower mainly used in an air conditioning device for an automobile. An impeller 7 is accommodated in a blower case 2 formed by joining a first case 5 and a second case 6. A bracket 3 for fixing the blower device at a mounting target is attached at an outer periphery of the blower case 2. The bracket 3 can be selectively attached at a desired attachment position at the outer periphery of the blower case 2.

In the blower device described in WO2019/163820, as illustrated in FIG. 7, a locking claw 30 is integrally formed at a leading end of the bracket 3 including a fixing mounting leg 4, recessed parts 31 are formed at a lower surface of the bracket 3, and the locking claw 30 is formed at a leading end of a projection part formed between the recessed parts 31. Projections 23 are formed at a blower lower case 6, a recessed part (groove) 22 is formed between the projections 23, and a bridge part 24 connecting the two projections 23 is formed at one end side (a blower upper case 5 side) of the recessed part (groove) 22.

Then, the locking claw 30 is inserted into the recessed part (groove) 22 located between the projections 23 formed at the blower lower case 6, the projections 23 formed at the blower lower case 6 are fitted and slid into the recessed parts 31 formed at the lower surface of the bracket 3, and after the locking claw 30 passes under the bridge part 24, the locking claw 30 is engaged with the bridge part 24, whereby the bracket 3 including the fixing mounting leg 3 is attached at the blower lower case 6. It is considered that such a blower device 1 can be attached to objects having various shapes at low cost, and at the same time, workability is improved.

SUMMARY

However, in the blower device described in WO2019/163820, since the locking claw 30 is disposed at the leading end of the bracket 3, there is a concern about a strength against a load in a direction of the bracket 3 moving away from the blower lower case 6 to the outside in a radial direction. In addition, since an interval between the projections 23 cannot be widened and the claw is formed to be small so as to fit with this narrow interval, there is a concern about an assembling strength. On the other hand, when the interval between the projections 23 is widened, the bridge part 24 is deflected, and also in this case, there is a possibility that a problem of an assembling strength or the like occurs. Further, since the two projections 23 having a narrow interval are arranged side by side to form a pair of assembling structures, there is a concern about securing an assembling accuracy.

The disclosure has been made in view of the above circumstances, and an object is to provide a blower device capable of securing a strength of an attachment portion and an assembling accuracy in attaching a bracket including a fixing mounting leg at an outer periphery of a case.

The disclosure provides a blower device including: a blower case configured to accommodate an impeller; and a fixing member attached to an outer periphery of the blower case and configured to fix the blower device at a mounting target. At an outer peripheral surface of the blower case, a pair of rail parts extending in a direction of a rotation axis of the impeller and an engagement rib connecting the rail parts to each other at intermediate portions of the rail parts in a longitudinal direction are provided. At the fixing member, a pair of fitting parts fitted with the pair of rail parts so as to be slidable in the direction of the rotation axis and a claw part disposed between the pair of fitting parts so as to be engaged with the engagement rib in the direction of the rotation axis are provided.

According to the disclosure, it is possible to obtain a blower device capable of securing a strength of an attachment portion and an assembling accuracy in attaching a bracket including a fixing mounting leg at an outer periphery of a case.

DESCRIPTION OF EMBODIMENTS

1. Structure of Blower Device

Figure 1:
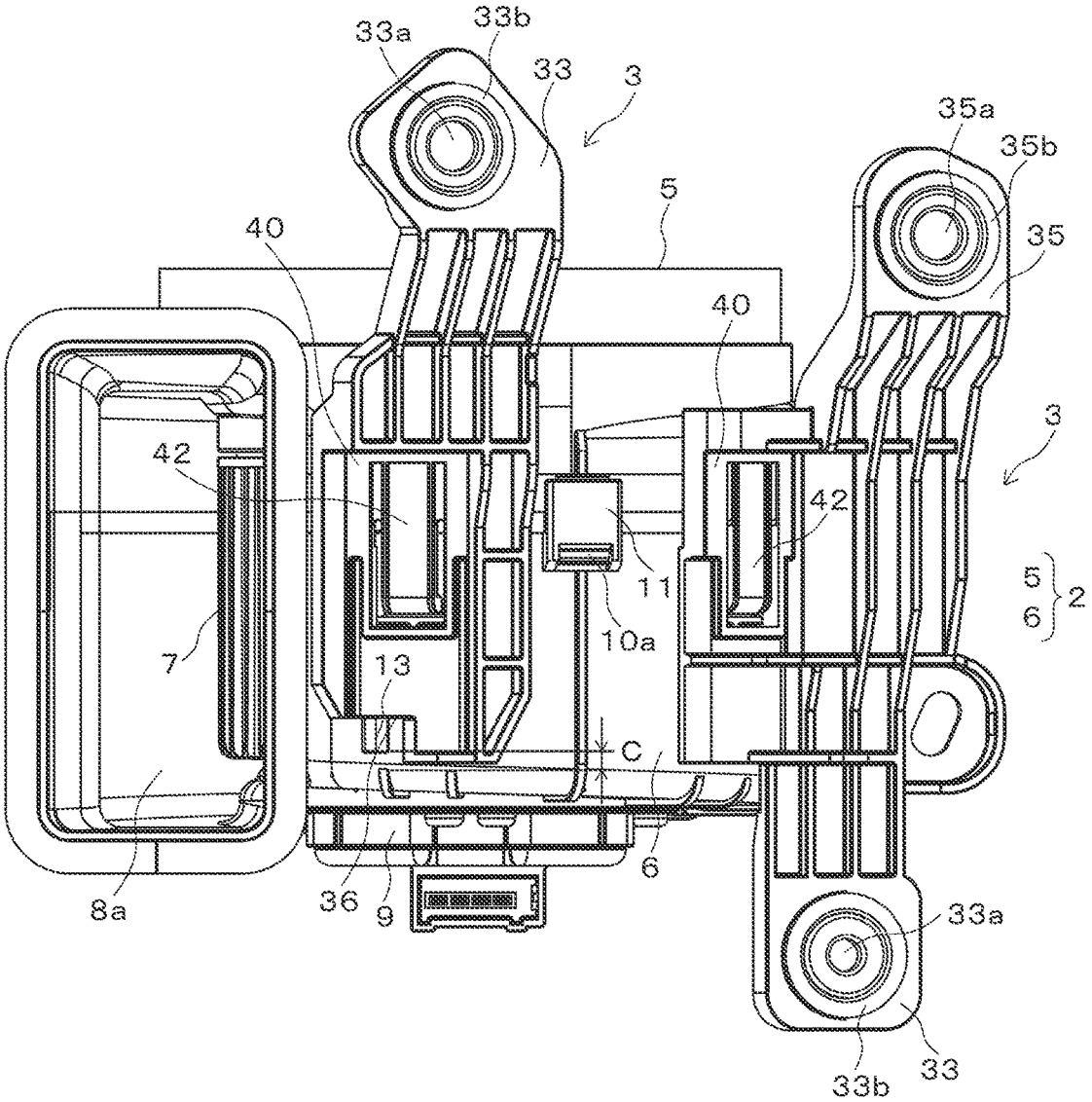
FIG. 1 is a side view of a blower device according to an embodiment of the disclosure.
Figure 2:
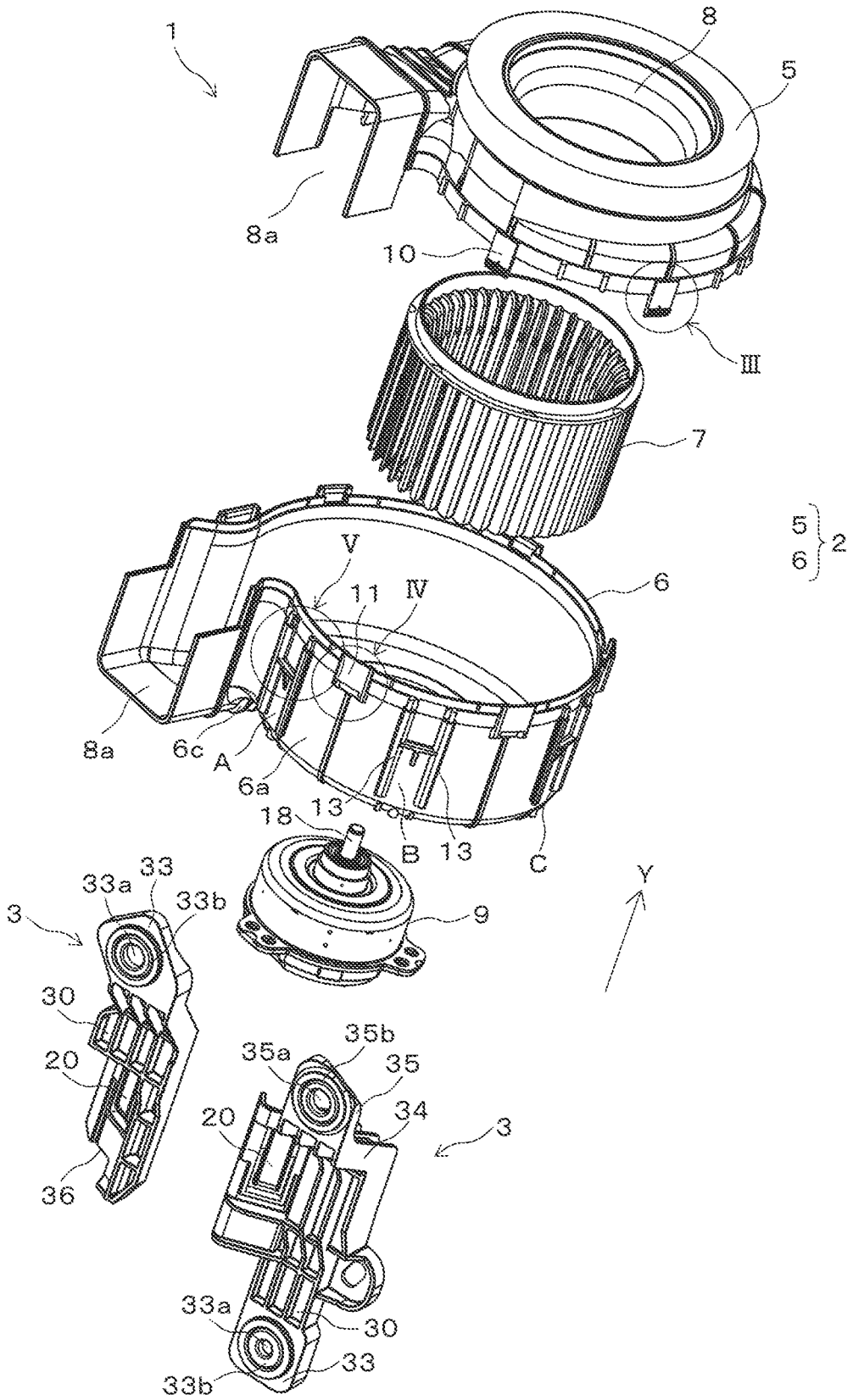
FIG. 2 is an exploded perspective view of the blower device according to the embodiment of the disclosure.
Figure 3:
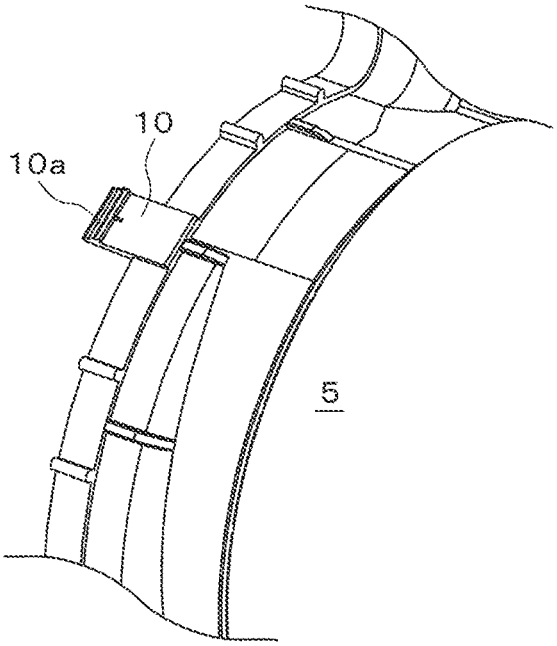
FIG. 3 is an enlarged view of a portion indicated by an arrow III in FIG. 2.
Figure 4A:
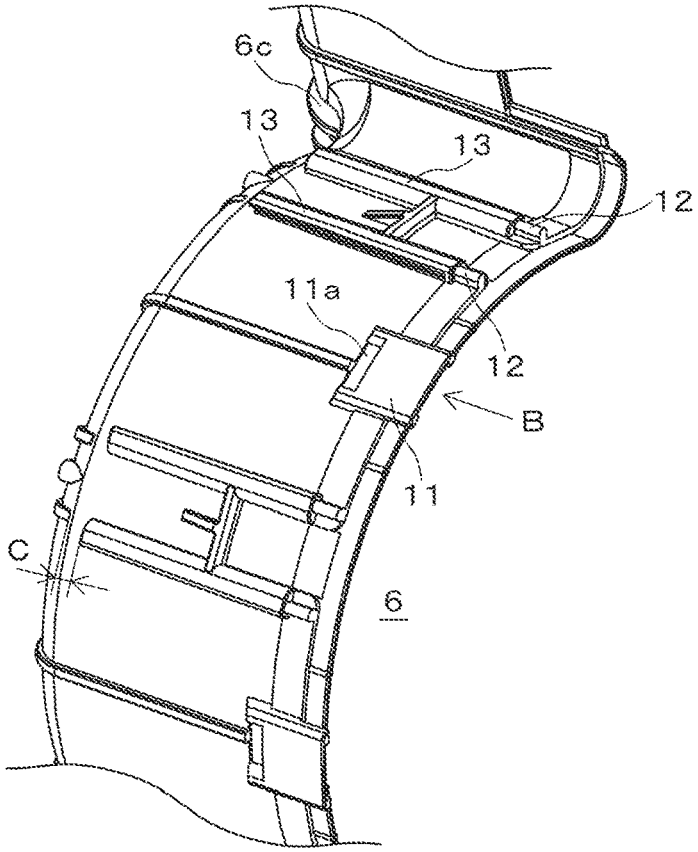
FIG. 4(A) is an enlarged view of a portion indicated by an arrow IV in FIG. 2.
Figure 4B:
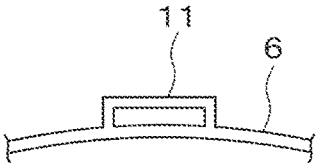
FIG. 4(B) is a view in a direction of an arrow B in FIG. 4(A).
Figure 5:
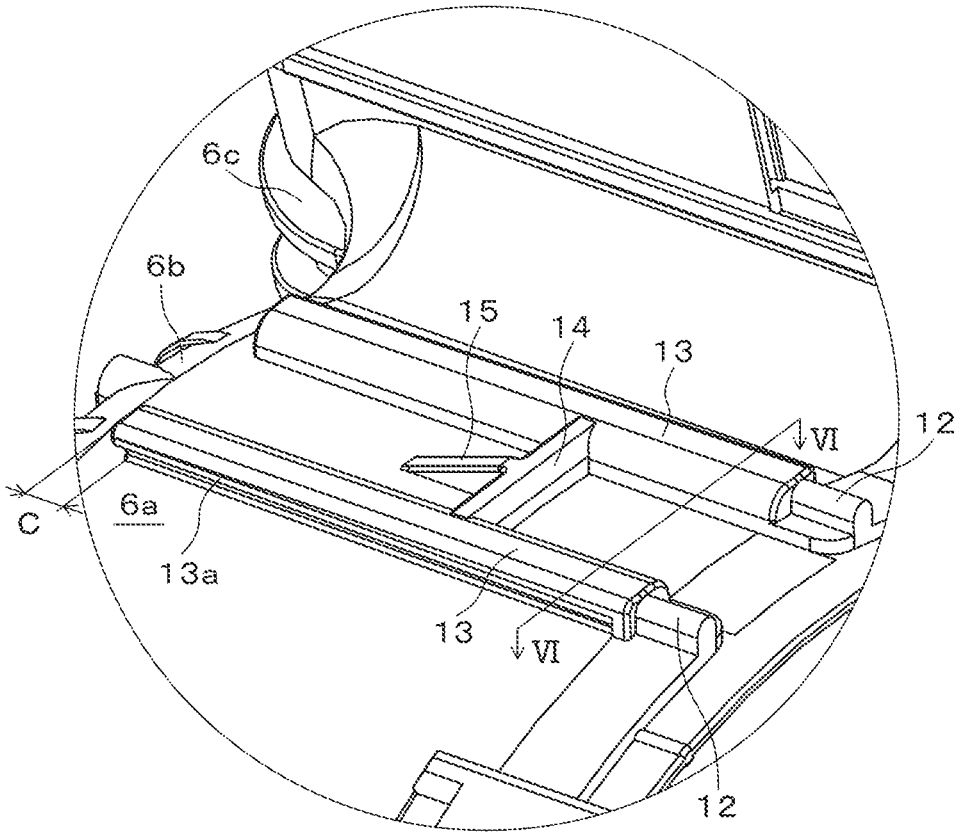
FIG. 5 is an enlarged view of a portion indicated by an arrow V in FIG. 2.

FIG. 1 is a side view of a blower device 1 according to the present embodiment, and FIG. 2 is an exploded perspective view. FIG. 3 is an enlarged view of a portion indicated by an arrow III in FIG. 2, FIGS. 4(A) and 4(B) are each an enlarged view of a portion indicated by an arrow IV in FIG. 2, and FIG. 5 is an enlarged view of a portion indicated by an arrow V in FIG. 2. A basic structure of the blower device 1 is substantially the same as the structure described in WO2019/163820, and includes a blower case 2 and a plurality of (two in this example) brackets 3. The plurality of brackets 3 are fixing members for fixing the blower case 2 at a mounting target.

The blower case 2 includes a blower upper case (first blower case) 5 and a blower lower case (second blower case) 6. An impeller is accommodated between the blower upper case 5 and the blower lower case 6, the impeller 7 being a blade part of the blower device 1 and promoting suction and blowing of air. The blower upper case 5 includes a suction port 8. A motor 9 being an electric motor for rotating the impeller 7 is fixed at a lower wall of the blower lower case 6. Note that, in the following description, a direction of a rotation axis of the motor 9 is referred to as an axial direction. In the axial direction, a direction indicated by an arrow Y in FIG. 2 is referred to as an upper side, and a direction opposite to the upper side is referred to as a lower side. A direction orthogonal to the rotation axis is referred to as a radial direction.

The motor 9 includes a shaft 18. The shaft 18 is a rotation shaft of the motor 9 and is a shaft connecting the impeller 7 and the motor 9. With this structure, the shaft 18 rotates the impeller 7 in accordance with the rotation of the motor 9. By the rotation of the impeller 7, the blower device 1 blows air sucked from the suction port 8 out from a blowout port 8*a*.

As illustrate in FIG. 3, a plurality of (six in this example) locking pieces 10 are formed at an outer peripheral part of the blower upper case 5 so as to project toward the blower lower case 6 side, and claw parts 10*a* are formed at leading ends of the locking pieces 10 so as to project to an outside in the radial direction. On the other hand, as illustrated in FIGS. 4(A) and (B), locking piece receiving parts 11 are formed at an outer peripheral part of the blower lower case 6 at positions corresponding to the locking pieces 10. The locking piece receiving part 11 has a rectangular tubular shape, and a cutout part 11*a* obtained by cutting out a wall part located outside in the radial direction is formed at a lower end portion of the locking piece receiving part 11 in the axial direction. Then, by inserting the locking pieces 10 into the locking piece receiving parts 11 and engaging the claw parts 10*a* with the cutout parts 11*a*, the blower upper case 5 and the blower lower case 6 are coupled to each other. In this coupled state, the blower upper case 5 and the blower lower case 6 are fitted with each other at fitting surfaces. The blowout port 8*a* is formed by coupling the blower upper case 5 and the blower lower case 6.

Figure 6:
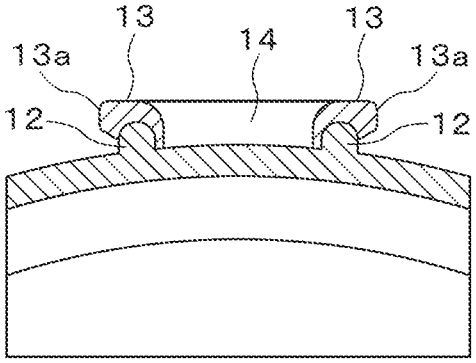
FIG. 6 is a cross-sectional view taken along a line VI-VI in FIG. 5.

As illustrated in FIG. 5, a pair of ridges 12 extending in the axial direction is formed at the outer peripheral part of the blower lower case 6, and rail parts 13 are fixed so as to cover the respective ridges 12. The ridges 12 exert an effect of further improving the rigidity against the deflection of the blower lower case 6. Note that the ridges 12 and the rail parts 13 may be integrally formed by injection molding. In addition, since the effect of improving the rigidity against the deflection can be obtained by the rail parts 13 without the ridges 12, the ridges 12 may be omitted. Whether or not the ridges 12 are provided can be appropriately selected in consideration of the magnitude of a stress applied and the like. As illustrated in FIG. 6, projection parts 13*a* are formed at top portions of side surfaces of the pair of rail parts 13 facing in directions opposite to each other, the projection parts 13*a* including upper end parts projecting in directions opposite to each other. In addition, an engagement rib 14 is bridged at the middle of the pair of rail parts 13 in a longitudinal direction, and an inclined rib 15 having a triangular shape and including an inclined surface having an ascending gradient toward the upper side in the axial direction is formed at the central portion of the engagement rib 14. The number of the pair of rail parts 13 is preferably as large as possible. This can increase variations in the attachment positions of a fixing mounting leg 33 to be described below, and as a result, application to various mounting targets can be realized.

As illustrated in FIGS. 4(A) and 4(B) and FIG. 5, the blower lower case 6 includes a curved wall 6*b* connecting a sidewall 6*a* and the lower wall, and a gap C is formed between a boundary between the curved wall 6*b* and the sidewall 6*a* and lower ends of the rail parts 13. An effect of the gap C will be described in detail below.

Figure 7:
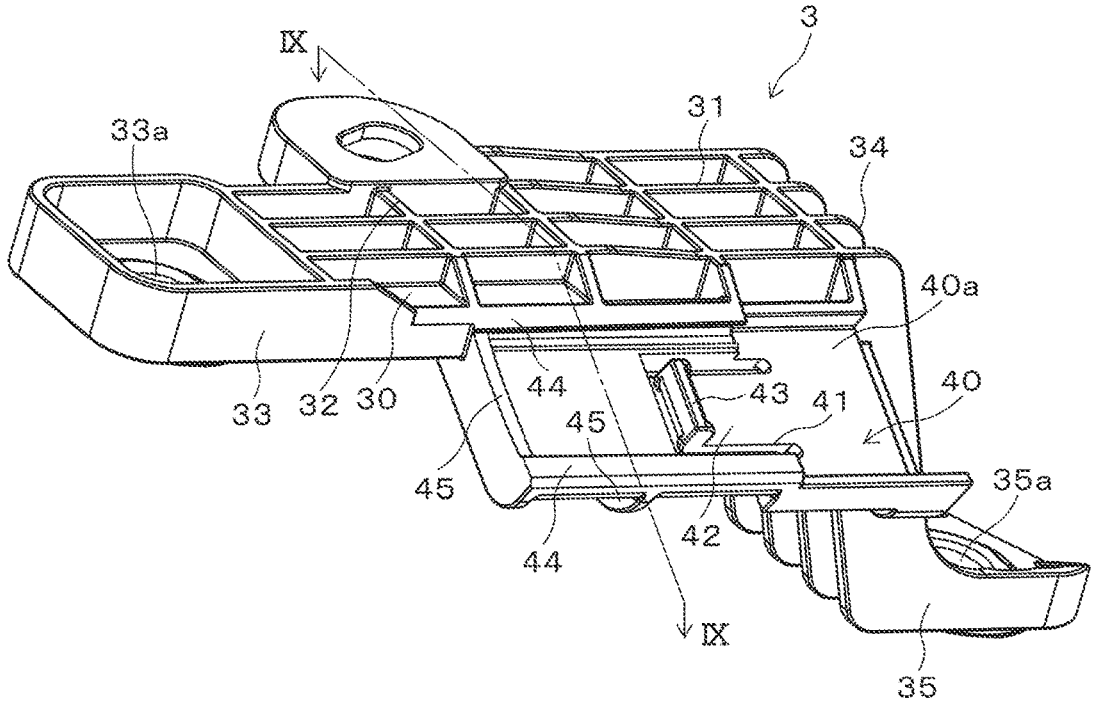
FIG. 7 is a perspective view illustrating a bracket according to the embodiment of the disclosure.
Figure 8:
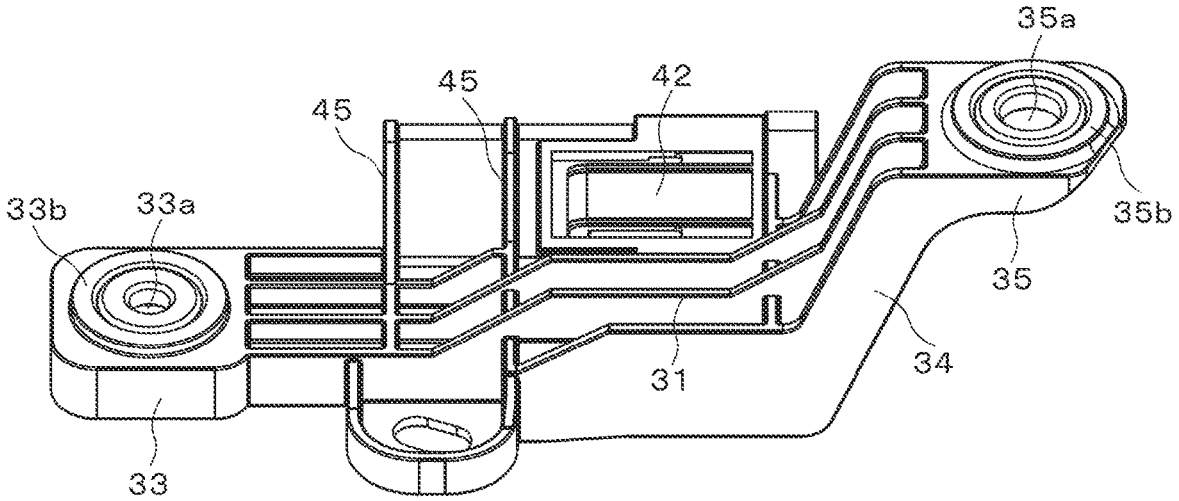
FIG. 8 is a perspective view of the bracket illustrated in FIG. 7 inverted upside down.

Next, the bracket 3 will be described. The bracket 3 is attachable to and detachable from the blower case 2. Note that, in the following description, the bracket 3 at the right side in FIG. 2 will be mainly described, and the description of the bracket 3 at the left side will be omitted because the configuration is equivalent. As illustrated in FIG. 7 and FIG. 8, the bracket 3 includes a horizontal plate part 30 having a substantially rectangular shape. The horizontal plate part 30 is formed with a plurality of longitudinal reinforcing parts 31 extending in the axial direction and a plurality of lateral reinforcing parts 32 orthogonal to the longitudinal reinforcing parts 31.

The fixing mounting leg 33 including a through hole 33*a* is formed at one end portions of the longitudinal reinforcing parts 31. The through hole 33*a* is used to mount the blower device 1 at a mounting target such as a vehicle body with a bolt or the like, and a metal collar 33*b* for reinforcement is fixed around the through hole 33*a*. In addition, the other end portions of the longitudinal reinforcing parts 31 are bent to form a plurality of inclined reinforcing parts 34, and a fixing mounting leg 35 including a through hole 35*a* is formed at leading end portions of the inclined reinforcing parts 34. A metal collar 35*b* for reinforcement is fixed around the through hole 35*a*. As described above, by providing the fixing mounting leg 35 at the leading end portions of the inclined reinforcing parts 34, the blower device I can be mounted at an arbitrary position away from the blower case 2. In addition, since the inclined reinforcing parts 34 have a rib shape, sufficient strength can be obtained at the bent portions.

Although one fixing mounting leg 33 is formed at the bracket 3 at the left side in FIG. 2, the number of the fixing mounting legs 33 is not limited as long as there is at least one fixing mounting leg 33. In addition, the shape of the fixing mounting leg 33 illustrated in the drawing is an example, and can be changed according to a shape of a mounting target or the like.

In a state of the bracket 3 being attached at the blower case 2, the fixing mounting legs 33 and 35 project in the axial direction from each end portion of the blower case 2 in the axial direction. Thus, when the fixing mounting legs 33 and 35 are mounted at a mounting target, the blower case 2 does not become an obstacle, and workability is improved.

In the bracket 3, an engaging part 40 arranged so as to cover the pair of rail parts 13 is provided adjacent to a side portion of the horizontal plate part 30. A cutout 41 having a U-shape is formed at the engaging part 40, an engaging piece 42 having a rectangular shape is formed inside the cutout 41. The engaging piece 42 can be elastically bent around the root of the engaging piece 42. A claw part 43 projecting in a direction substantially orthogonal to the engaging piece 42 is formed at a leading end of the engaging piece 42.

Figure 9:
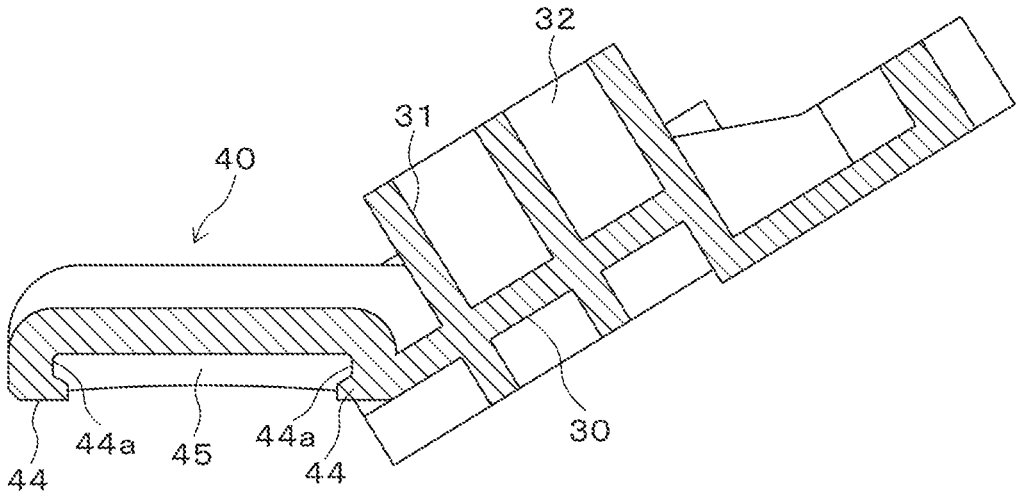
FIG. 9 is a cross-sectional view taken along a line IX-IX in FIG. 7.

As illustrated in FIG. 9, a side plate part 44 projecting in a plate thickness direction and extending in the axial direction is formed at both side portions of the engaging part 40, and a groove (fitting part) 44*a* is formed inside the side plate part 44. The groove 44*a* has a concave shape having the same contour as the projection part 13*a* of the rail part 13 described above, and the groove 44*a* and the projection part 13*a* are engaged with each other so as to form a structure. In the structure, sliding in the axial direction is possible and relative movement in other directions is impossible. In addition, a reinforcing arm part 45 being an extension of the lateral reinforcing part 32 is formed at one end portion and an intermediate portion of the engaging part 40 in the axial direction so as to support the engaging part 40. Further, the reinforcing arm part 45 at the one end portion side of the engaging part 40 is connected to the side plate part 44 and functions as a positioning stopper coming into contact with end surfaces of the rail parts 13.

2. Attaching Bracket at Blower Lower Case

The bracket 3 at the left side and the bracket 3 at the right side in FIG. 2 can be attached at any of the rail parts 13 indicated by A, B, and C in FIG. 2. A cutout part 36 located at one end of the bracket 3 at the left side is provided to avoid an adjacent component or the like (not illustrated) when the blower device 1 is mounted at a mounting target. Thus, when there is no adjacent component or the like to be avoided, the cutout part 36 may be omitted. Here, FIG. 5 illustrates the rail parts 13 at A, and FIG. 7 and FIG. 8 illustrate the bracket 3 at the right side. Therefore, for the sake of convenience, FIG. 5 is used as illustrating the rail parts 13 at B in the following description.

As illustrated in FIG. 5, the gap C is provided between the boundary between the curved wall 6*b* and the sidewall 6*a* of the blower lower case 6 and the lower end of the rail parts 13, and an upper end part 40*a* of the engaging part 40 illustrated in FIG. 7 is placed on the sidewall 6*a* at the gap C such that the bracket 3 can be moved in the axial direction (Y direction). Accordingly, after positioning of the sidewall 6*a* and the engaging part 40 is first performed at the gap C, an operation of moving in the axial direction can be performed, and thus the workability is improved. Then, when the grooves 44*a* of the engaging part 40 of the bracket 3 are aligned with the pair of rail parts 13 and the grooves 44*a* and the rail parts 13 are fitted together and moved in the axial direction, the claw part 43 rides on the inclined rib 15 and the engaging piece 42 is elastically deformed. When the claw part 43 gets over the engagement rib 14, the engaging piece 42 is elastically restored and the claw part 43 is engaged with the engagement rib 14. At the same time, the reinforcing arm part 45 of the engaging part 40 comes in contact with the end surfaces of the rail parts 13, and the bracket 3 is fixed in the axial direction.

3. Effect

In the blower device 1 having the above-described configuration, the pair of rail parts 13 extending in the axial direction and the engagement rib 14 connecting the rail parts 13 to each other at the intermediate portions of the rail parts 13 in the longitudinal direction are provided at the outer peripheral surface of the blower lower case 6, and the pair of grooves 44*a* to be fitted slidably in the axial direction with the pair of rail parts 13 and the claw part 43 disposed between the pair of grooves 44*a* and engaged with the engagement rib 14 in the axial direction are provided at the bracket 3. Therefore, the size of the claw part 43 can be set depending on the width of the pair of the rail parts 13, whereby the assembling strength is improved. Further, by providing the pair of rail parts 13 having a relatively large width, dimensional accuracy can be more reliably ensured, and assemblability is improved.

Furthermore, since the rail parts 13 and the grooves 44*a* are first fitted with each other, positioning in a direction orthogonal to an insertion direction (axial direction) of the bracket 3 is performed. Accordingly, the insertion work is facilitated, and the workability is improved. In addition, since the claw part 43 is disposed at a position away from an end portion of the bracket 3 in the insertion direction by a predetermined distance, a load in a direction away from the blower case 2 is less likely to be applied to the claw part 43, and thus strength is improved.

In particular, in the above-described embodiment, since the engagement rib 14 is provided with the inclined rib 15 including the inclined surface having an ascending gradient toward the insertion direction of the bracket, the claw part 43 can easily get over the inclined rib 15 and the engagement rib 14 to be engaged, by inserting the rail parts 13 into the grooves 44*a* and sliding the rail parts 13. In addition, the inclined rib 15 extends in a direction for supporting a load acting on the engagement rib 14 when a load in a direction opposite to the insertion direction, that is, a load in a direction for detaching the claw part 43 acts on the claw part 43, and thus the inclined rib 15 also has an effect of reinforcing the engagement rib 14. This further enhances an engaged state, and thus, in a case of mounting on a vehicle or the like, vibration of the engaged portion due to vibration or the like during traveling is suppressed, and thus it is possible to suppress generation of noises or the like.

In the above-described embodiment, since the reinforcing arm part 45 coming into contact with end portions of the rail parts 13 is provided at end portions of the grooves 44*a*, it is possible to restrict displacement of the bracket 3 not only in the insertion direction but also in a direction orthogonal to the insertion direction and to realize more rigid attachment to the blower case 2. In addition, since the reinforcing arm part 45 continuous from the lateral reinforcing part 32 is robust against deflection in a direction away from the blower case 2, it is possible to more effectively suppress detachment of the bracket 3 from the rail parts 13.

In the above-described embodiment, the pair of rail parts 13 include the projection parts 13*a* including upper end parts having convex shapes facing opposite directions to each other, and the grooves 44*a* have the same concave shapes as the cross-sectional shapes of the projection parts 13*a*, and thus displacement of the grooves 44*a*, that is, displacement of the bracket 3 in a direction other than the axial direction is restricted. In addition, an operation of inserting the pair of grooves 44*a* into the pair of rail parts 13 is performed with good workability, and moreover, firm fixation is possible.

The blower lower case 6 includes the sidewall 6*a* having a substantially cylindrical shape, the lower wall having a substantially disk shape, and the curved wall 6*b* having an arc-like cross-sectional shape and connecting the sidewall 6*a* and the lower wall, and the gap C is provided between the boundary between the curved wall 6*b* and the sidewall 6*a* and the end portions of the rail parts 13. Therefore, the position of the grooves 44*a* can be aligned with the rail parts 13 by placing the upper end part 40*a* of the engaging part 40 illustrated in FIG. 7 on the sidewall 6*a* at the gap C, and an operation of fitting the grooves 44*a* and the rail parts 13 can be easily performed.

4. Modification Examples

The present disclosure is not limited to the embodiment described above, and it is possible to make various modifications as described below.

i) The grooves 44*a* are fitted with the rail parts 13 in the above-described embodiment. However, projection parts under the grooves 44*a* illustrated in FIG. 9 may be fitted with grooves under the projection parts 13*a* illustrated in FIG. 6.

ii) The rail parts 13 and the like are provided at the blower lower case 6 in the above-described embodiment, but may be provided at the blower upper case 5.

INDUSTRIAL APPLICABILITY

The disclosure is applicable to a blower device used for air blowing, ventilation, cooling, and the like in household electrical appliances, office automation equipment, and industrial and vehicular equipment.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A blower device comprising:

a blower case configured to accommodate an impeller, the blower case comprising a blower upper case and a blower lower case; and a fixing member attached to an outer periphery of the blower case and configured to fix the blower device at a mounting target, wherein an outer peripheral surface of the blower case includes a pair of rail parts extending in a direction of a rotation axis of the impeller, and an engagement rib configured to connect the rail parts to each other at intermediate portions of the rail parts in a longitudinal direction, wherein the fixing member includes a pair of fitting parts configured to be fitted with the pair of rail parts and slidable in an axial direction which is parallel to the direction of the rotation axis and extends from the blower lower case to the blower upper case, and a claw part disposed between the pair of fitting parts and configured to be engaged with the engagement rib in the direction of the rotation axis, wherein the pair of rail parts include a plurality of pairs of rail parts disposed along the outer periphery of the blower case, wherein the fixing member is selectively attachable at the pair of rail parts, wherein the blower case includes a sidewall, a lower wall, and a curved wall configured to connect the sidewall and the lower wall, wherein a gap is provided between a boundary between the curved wall and the sidewall and lower ends of the rail parts in the axial direction, and wherein the gap comprises a surface that extends along the sidewall in a circumferential direction about the rotation axis.

2. The blower device according to claim 1, wherein the claw part is configured to get over the engagement rib to become engaged with the engagement rib by an insertion and sliding of the pair of rail parts into the pair of fitting parts, and the engagement rib is provided with an inclined rib including an inclined surface having an ascending gradient toward a direction of the insertion and sliding of the pair of rail parts into the pair of fitting parts.

3. The blower device according to claim 1, wherein a contacting part configured to come into contact with end portions of the pair of rail parts are provided at end portions of the pair of fitting parts.

4. The blower device according to claim 1, wherein the pair of rail parts include projection parts including upper end parts having convex shapes facing opposite directions to each other, and the pair of fitting parts have the same concave shapes as cross-sectional shapes of the projection parts.

5. The blower device according to claim 1, wherein a pair of ridges extending in the direction of the rotation axis are provided at the outer peripheral surface of the blower case, and the pair of rail parts are fixed so as to cover the pair of ridges.

6. The blower device according to claim 1, the blower upper case is provided with a locking piece projecting in the direction of the rotation axis, and the blower lower case is provided with a locking piece receiving part, and the locking piece is inserted into the locking piece receiving part so as to be engaged.

7. The blower device according to claim 6, wherein the locking piece receiving part has a tubular shape having a rectangular cross section, a claw part projecting to an outside in a radial direction is provided at a leading end portion of the locking piece, and a cutout part configured to be engaged with the claw part is provided at an end portion of the locking piece receiving part in the direction of the rotation axis.

8. The blower device according to claim 1, wherein one end portions of the rail parts are inserted into the fitting parts, the fixing member is slidden toward another end portions of the rail parts, and the gap is disposed between the one end portions of the rail parts and the curved wall.

9. A blower device comprising:

a fixing member attached to an outer periphery of a blower case and configured to fix the blower device at a mounting target, wherein an outer peripheral surface of the blower case includes:

a pair of rail parts extending in a direction of a rotation axis of an impeller, and an engagement rib bridged at a middle of the pair of rail parts at an intermediate portion of each of the pair of rail parts in a longitudinal direction, and an inclined rib having a triangular shape and including an inclined surface having an ascending gradient toward an upper side in an axial direction is formed at a central portion of the engagement rib, wherein the fixing member includes:

a pair of fitting parts configured to be fitted with the pair of rail parts and slidable in the direction of the rotation axis, and a claw part disposed between the pair of fitting parts and configured to be engaged with the engagement rib in the direction of the rotation axis, wherein the pair of rail parts include a plurality of pairs of rail parts disposed along the outer periphery of the blower case, and wherein the fixing member is selectively attachable at the pair of rail parts, wherein the blower case comprises a blower upper case and a blower lower case, the blower case includes a sidewall, a lower wall, and a curved wall configured to connect the sidewall and the lower wall, wherein a gap is provided between a boundary between the curved wall and the sidewall and lower ends of the rail parts in the axial direction, and wherein the gap comprises a surface that extends along the sidewall in a circumferential direction about the rotation axis, wherein the fixing member includes a first fixing mounting leg projecting to one end side in a direction of the rotation axis, second fixing mounting leg projecting from an end portion of the first fixing mounting leg to another end side in the direction of the rotation axis, and an engaging part projecting from an intermediate portion between the first and second mounting legs in a circumferential direction about the rotation axis, and the pair of fitting parts are disposed at the engaging part.

10. The blower device according to claim 9, wherein the engaging part includes a cutout part formed by cutting a wall portion of the engaging part into a U-shape, and the claw part projecting to an inside in a radial direction is provided at a tip end of the cutout part.

* * * * *